US009063465B2

(12) United States Patent
Huang et al.

(10) Patent No.: US 9,063,465 B2
(45) Date of Patent: Jun. 23, 2015

(54) TONER CARTRIDGE

(75) Inventors: Zongqian Huang, Zhuhai (CN); Honghui Zhou, Zhuhai (CN)

(73) Assignee: PRINT-RITE• UNICORN IMAGE PRODUCTS CO., LTD. OF ZHUHAI (CN)

( * ) Notice: Subject to any disclaimer, the term of this patent is extended or adjusted under 35 U.S.C. 154(b) by 0 days.

(21) Appl. No.: 14/233,806

(22) PCT Filed: Jul. 10, 2012

(86) PCT No.: PCT/CN2012/078397

§ 371 (c)(1),
(2), (4) Date: Jan. 20, 2014

(87) PCT Pub. No.: WO2013/013572

PCT Pub. Date: Jan. 31, 2013

(65) Prior Publication Data

US 2014/0169837 A1 Jun. 19, 2014

(30) Foreign Application Priority Data

Jul. 22, 2011 (CN) ..... 2011 1 0206041

(51) Int. Cl.
*G03G 15/08* (2006.01)

(52) U.S. Cl.
CPC ..... *G03G 15/0886* (2013.01); *G03G 15/087* (2013.01); *G03G 15/0872* (2013.01)

(58) Field of Classification Search
USPC ..... 399/107, 110, 119, 120, 222, 252, 258, 399/260, 262
See application file for complete search history.

(56) References Cited

U.S. PATENT DOCUMENTS 8,170,452 B2 * 5/2012 Tamura ..... 399/258
8,295,742 B2 * 10/2012 Yamaguchi et al. ..... 399/262

FOREIGN PATENT DOCUMENTS

| | | | |
|---|---|---|---|
| CN | 2630903 | Y | 8/2004 |
| CN | 101916059 | A | 12/2010 |
| CN | 102331697 | A | 1/2012 |
| JP | 2008129287 | A | 6/2008 |

OTHER PUBLICATIONS

International Search Report for Application No. PCT/CN2012/078397 dated Oct. 25, 2012.

* cited by examiner

*Primary Examiner* — Hoan Tran
(74) *Attorney, Agent, or Firm* — Lerner, David, Littenberg, Krumholz & Mentlik, LLP

(57) ABSTRACT

Disclosed is a toner cartridge. The toner cartridge comprises a rotary container body, a toner discharge port, a sealing component, a connection component and a transmission component. The toner discharge port is placed on the rotary container body. The sealing component is placed inside the toner discharge port. The connection component is slide-connected with the toner discharge port. The transmission component is slide-connected with the connection component. When the transmission component is driven to rotate, it drives the connection component, the toner discharge port, and the rotary container body to rotate together.

9 Claims, 3 Drawing Sheets

TONER CARTRIDGE

CROSS-REFERENCE TO RELATED APPLICATIONS

The present application is a national phase entry under U.S.C. §371 of International Application No. PCT/CN2012/078397, filed Jul. 10, 2012, which claims priority from Chinese Patent Application No. 201110206041.2, filed Jul. 22, 2011, all of which are incorporated herein by reference.

FIELD OF THE INVENTION

The present invention relates to a charging device charging a photosensitive drum of a photosensitive drum component and the photosensitive drum component applying the charging device.

TECHNICAL BACKGROUND OF THE INVENTION

FIG. 1 shows an existing toner cartridge. The toner cartridge body 100 has a cylindrical toner discharge port 101. The toner discharge port 101 is provided with a connection device 110. The connection device 110 has a sealing component 111 which is used to seal the toner discharge port 101 and two grippers 112 which extend from the sealing component 111. The other end of the connection device 110 has several elastic walls 113 which are provided with hook-shaped projections 114. In the original state, the sealing component 111 seals the toner discharge port 101. When the toner cartridge is installed on the machine, the hook-shaped projections 114 of the connection device 110 are deformed inwards with the elastic walls 113 and are then connected to the rotation transferring component 120 inside the image processing system. The connection device 110 is fixed on the rotation transferring component 120 and it pulls back the toner cartridge body 100 through the operation handle, and thus it pulls off the sealing component 111 of the connection device 110 and opens the toner discharge port 101. When the rotation transferring component 120 rotates, the side walls of the hook-shaped projections 114 of the connection device 110 receive the driving force and drive the toner cartridge to rotate.

Technical Issues

Although the above toner cartridge has simplified the transmission structure, it has the following drawbacks.

1. Because the driving and the transmission connection are accomplished by hook-shaped projections 114, the bottom and the side surfaces of the hook-shaped projections 114 bear the driving force and they are thus easy to deform and damage. This may result in operation instability, increasing the materials requirement, and increasing the costs.
2. The toner discharge port 101 is opened by the operation handle. This makes the operation more difficult. If the installation is not perfect, the toner discharge port 101 may not open.
3. After the toner discharge port 101 opens, the connection between the connection device 110 and the toner cartridge body 100 relies on the two grippers 112 and it is not axially fixed. This may cause instability when the toner cartridge body 100 rotates, toner discharge inconsistency, and noise.

Technical Solutions

The invention overcomes the above-mentioned drawbacks of the existing toner cartridges and provides a toner cartridge that has an improved transmission receiving structure and makes the toner cartridge structure more reasonable and operation more stable.

The invention uses the following technical scheme to resolve the technical problem. The toner cartridge of the invention comprises:

a rotary container body for storing the toner;

a toner discharge port comprising a cylinder; one end of the cylinder is connected with the rotary container body and the other end of the cylinder is provided with a cap; the cylinder has a toner discharge opening; and the cap is provided with a connection component compartment which extends outwards from the cap;

a sealing component; the sealing component is installed inside the cylinder and opens and closes the toner discharge opening through its axial movement;

a driving rod for driving the sealing component to move axially; one end of the driving rod passes through the cap into the cylinder and is then connected with the sealing component; and the cap has an opening for the driving rod to pass through it;

a connection component which is slide-connected with the inner wall of the connection component compartment; the connection component compartment rotates with the connection component; the connection component has several hook-shaped projections; the side surface of the hook-shaped projections is sloped or arc-shaped; and a transmission component which is slide-connected with the connection component; the connection component rotates with the transmission component; and the transmission component has at least one transmission projection.

The above transmission structure further comprises a rotation transferring component which is installed inside the image processing system wherein the driving rod of the sealing component drives the sealing component to move axially, which opens the toner discharge opening. The rotation transferring component comprises a circular wall and a transmission shaft which is co-axial with the circular wall. The circular wall has a connection opening which extends from the surrounding of the circular wall.

When the rotation transferring component is connected with the toner cartridge, the transmission shaft drives the driving rod of the sealing component to move axially and open the toner discharge opening.

In the toner cartridge of the invention, the outline of the side surface of the driving projection is triangular or arc shaped.

In the toner cartridge of the invention, the connection component comprises a circle-shaped base and several elastic linking arms which extend from the circle of the circle-shaped base along the axial direction; the hook-shaped projections are formed at the end of the elastic linking arms; the base has an opening which allows the driving rod of the sealing component to pass through.

In the toner cartridge of the invention, the inner wall of the connection component compartment is provided with axially extending ridges and the external periphery is provided with sliding grooves which match the ridges.

In the toner cartridge of the invention, the base has a positioning post which extends axially from the base; the transmission component has a bottom; and the bottom has a positioning opening which matches the positioning post.

In the toner cartridge of the invention, the above-described bottom has an elastic driving arm which extends from the bottom; the driving projection is formed at the end of the elastic driving arm; and the bottom has an opening to allow the driving rod of the sealing component to pass through it.

In the toner cartridge of the invention, the sealing component comprises a ring and a sleeve which is coaxial with the ring; and the driving rod of the sealing component is fixed inside the sleeve.

In the toner cartridge of the invention, the sleeve is provided with two opposite openings; the end of the driving rod of the sealing component is provided with two elastic latches; and the elastic latches are latched in the openings.

In the toner cartridge of the invention, the end of the driving rod of the sealing component that cooperates with a transmission shaft has a pit, and the transmission shaft is conically shaped.

Effectiveness of the Invention

In the toner cartridge of the invention, the connection component, the transmission component, and the sealing component are independent and each performs its own function. This structure ensures operating stability and reduces the material quality requirement allowing more environmentally friendly materials to be used in the invention. The transmission component and the connection component can axially move relative to the connection component compartment 22; this structure makes the rotation of the operation handle easier and more convenient. The container component of the toner cartridge and the rotation transferring component of the developer are fixed along the axial direction; this helps steady rotation.

EMBODIMENTS OF THE INVENTION

Figure 1:
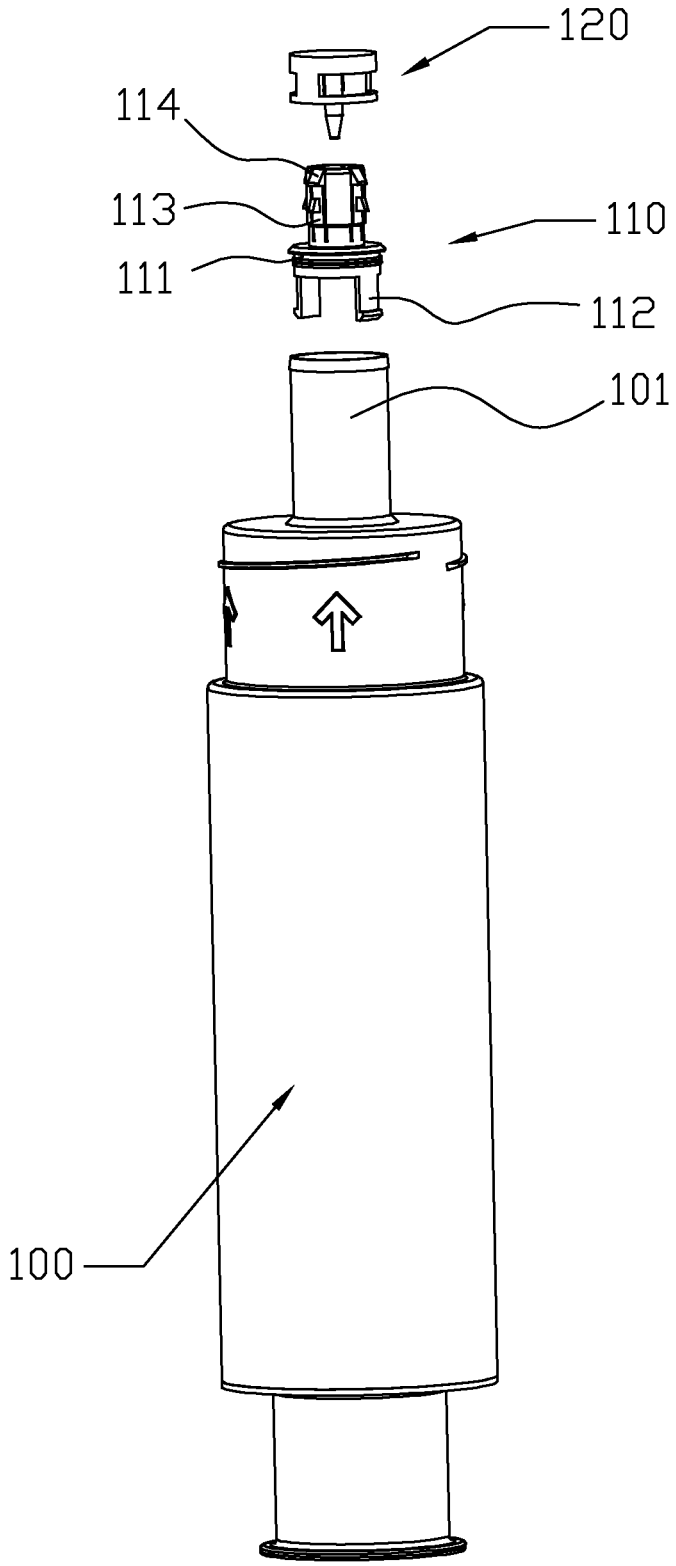
FIG. 1 is an illustrative view of an existing toner cartridge.
Figure 2:
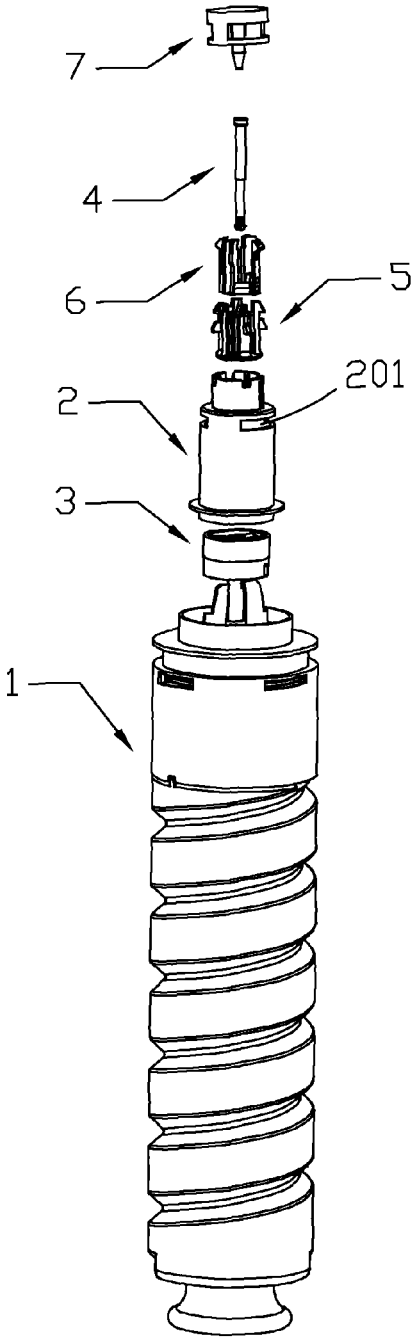
FIG. 2 is an exploded view of a toner cartridge embodiment of the invention. This figure also shows the rotation transferring component inside the image processing system.
Figure 3:
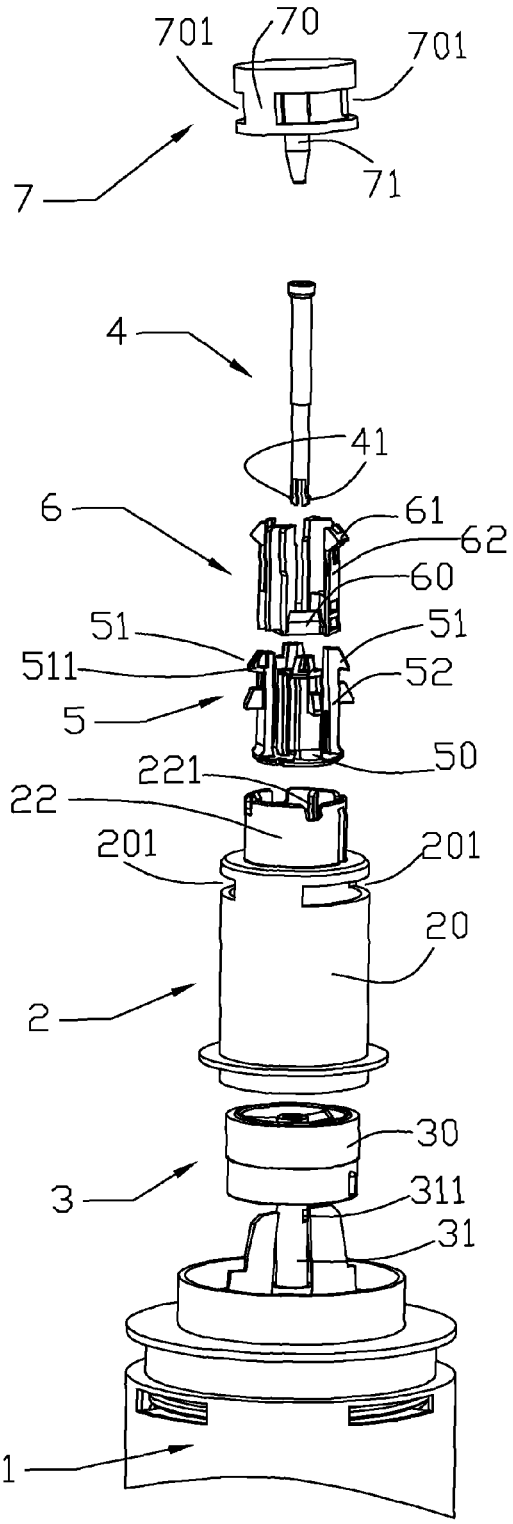
FIG. 3 is a partially enlarged view of FIG. 2.
Figure 4:
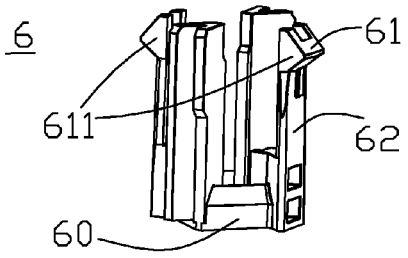
FIG. 4 is an enlarged view of the transmission component of the toner cartridge embodiment of the invention.

The invention is further illustrated by the combination of the drawings and the embodiments below.

FIGS. 2, 3, 6 and 7 show a preferred embodiment of the toner cartridge of the invention. The toner cartridge of the invention is used in an image processing system such as in the developer of a printer or a copy machine. In this embodiment, the toner cartridge comprises a rotary container body 1. The rotary container body 1 is used to store the toner and it is driven by the rotation transferring component of the developer.

The end of the rotary container body 1 is provided with a toner discharge port 2. The toner discharge port 2 comprises a cylinder 20. An end of the cylinder 20 is connected with the rotary container body 1 and the other end of the cylinder is provided with a cap. The cylinder 20 has a toner discharge opening 201, toner can flow to the cylinder 20 from the rotary container body 1, the toner discharge opening 201 discharges the toner to the toner accepting component of the image processing system. There can be more than one toner discharge opening 201. The toner discharge opening 201 can be a strip that extends from the cylinder 20. The cap is provided with a connection component compartment 22 which extends outwards from the cap. The connection component compartment 22 is used to cooperate with the connection component 5.

The toner discharge opening 201 of the toner discharge port 2 opens when the toner cartridge is installed on the developer; when it is not being used, it is sealed. Therefore, the toner discharge port 2 is provided with a sealing component 3. The sealing component 3 is installed inside the cylinder 20; it opens or closes the toner discharge opening 201 through its axial movement. The sealing component 3 comprises a ring 30 and a sleeve 31 which is coaxial to the ring 30. The sleeve 31 and the ring 30 are linked through a ridge-shaped structure. Axial movement of the ring 30 drives the sealing component 3 to open or close the toner discharge opening 201. The sealing component is driven by the driving rod 4. The driving rod 4 of the sealing component is rod-shaped. In this embodiment, it is a rounded rod. One end of the driving rod 4 passes through the cylinder 20 and it is then connected with the sealing component 3; and the cap has an opening for the driving rod 4 to pass through. In this embodiment, the driving rod 4 passes through the sleeve 31 and then connects with the sealing component 3. The sleeve 31 is provided with two opposite openings 311; the end of the driving rod 4 of the sealing component is provided with two elastic latches 41; and the elastic latches 41 are latched in the openings 311.

In this embodiment, the toner cartridge comprises a connection component 5. The connection component 5 is slide-connected with the connection component compartment 22 of the toner discharge port 2. The connection component compartment 22 rotates with the connection component 5, and it drives the container body 1 to rotate. The connection component 5 comprises a circle-shaped base 50 and several elastic linking arms 52 which are formed by the extension from the circle 50 of the circle-shaped base 50 along the axial direction. The end of each elastic linking arm 52 has a hook-shaped projection 51. The base 50 has an opening which allows the driving rod 4 of the sealing component to pass through. The side surface 511 of each hook-shaped projection 51 of the connection component 5 is sloped or arc-shaped, and therefore when it couples with the rotation transferring component 7, the connection component 5 only has a connecting function, but does not directly burden the driving force from the rotation transferring component 7. The inner wall of the connection component compartment 22 is provided with axially extending ridges 221 and the external periphery of the base 50 is provided with the sliding grooves 501 which cooperate with the ridges 221. There can be several ridges 221 and several corresponding grooves 501. When they are combined, the ridges 221 are inserted into the grooves 501, and thus the connection component 5 and the connection component compartment 22 restrict each other and the connection component compartment 22 rotates with the connection component 5.

Figure 5:
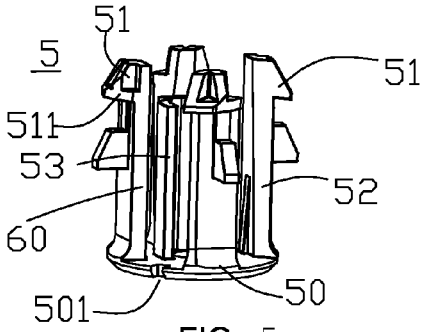
FIG. 5 is an enlarged view of the connection component of the toner cartridge embodiment of the invention.

In this embodiment, the toner cartridge further comprises a transmission component 6 which is used to transmit the driving force from the rotation transferring component 7 to the toner cartridge. The transmission component 6 is slide-connected with the connection component 5. The connection component 5 rotates with the transmission component 6. The base 50 of the connection component 5 has a positioning post 53 which extends axially from the base portion 50. See FIG. 5. The transmission component 6 has a bottom 60; the bottom 60 has an opening which cooperates with the positioning post 53. There can be multiple positioning posts which are evenly distributed along the base 50. There can also be multiple positioning openings. When the transmission component 6 is covered inside the connection component 5, the positioning post 53 is inserted into the positioning opening. The positioning post 53 can also be prismatic or cylindrical. Thus the transmission component 6 and the connection component 5 restrict each other and the connection component 5 rotates with the transmission component 6. The transmission component 6 has an elastic driving arm 62 which extends from the bottom 60. A driving projection 61 is formed at the end of the elastic driving arm 62. There can be one or more elastic driving arms 62. There can also be one or more corresponding driving projections 61. The bottom 60 of the transmission component 6 is also provided with an opening which allows the driving rod 4 of the sealing component to pass through. To make the connection and disconnection between the transmission component 6 and the rotation transferring component more convenient, the side surface 611 of the driving projections 61 is preferably triangular or arc-shaped; in this embodiment, it is triangular.

In the original state of the toner cartridge, i.e., before the toner cartridge is installed on the developer, the ring 30 of the sealing component 3 seals the toner discharge opening 201 of the toner discharge port 2, and the connection component 5 and the transmission component 6 cover the driving rod 4 of the sealing component. Due to the space restriction at the end of the driving rod 4 of the sealing component, the connection component 5 and the transmission component 6 are restricted to the end of the toner discharge port 2.

The transmission structure of the toner cartridge is the rotation transferring component 7. The rotation transferring component 7 is installed inside the image processing system and it comprises a circular wall 70 and a transmission shaft 71 which is coaxial with the circular wall 70. The circular wall 70 and the transmission shaft can be linked through a ribbed plate or an end circle structure. The circular wall 70 has a connection opening 701 which extends from the surrounding of the circular wall 70. There can be one or more connection openings 701. Preferably, there are two connection openings 701, which help the transmission structure to bear the force evenly.

When the rotation transferring component 7 is linked with the toner cartridge, i.e., the toner cartridge is installed on the developer, the transmission shaft 71 of the transmission component pushes the driving rod 4 of the sealing component, the driving rod 4 pushes the sealing component 3 to move axially relative to the toner discharge port 2 to open the toner discharge opening 201. The hook-shaped projection 51 of the connection component 5 and the transmission projection 61 of the transmission component 6 are coupled with the connection opening 701. That is, both the hook-shaped projection 51 and the transmission projection 61 are inside the connection opening 701. When the rotation transferring component 7 rotates, the end of the connection opening 701 pushes the transmission projection 61, the transmission component 6 receives the driving force from the rotation transferring component 7, and the transmission component 6 rotates with the rotation transferring component 7. Because the side surface 511 of the connection projection 51 of the connection component 5 is sloped or arc-shaped, the guiding function of the side surface makes the elastic connection arm 52 to deform and contract, and thus the connection component 5 does not directly bear the driving force from the rotation transferring component 7. To make the coordination between the transmission shaft 71 and the driving rod 4 of the sealing component easier, the end of the driving rod 4 of the sealing component where it cooperates with the transmission shaft 71 is provided with a pit and the end of the transmission shaft 71 is designed to be conical.

Figure 6:
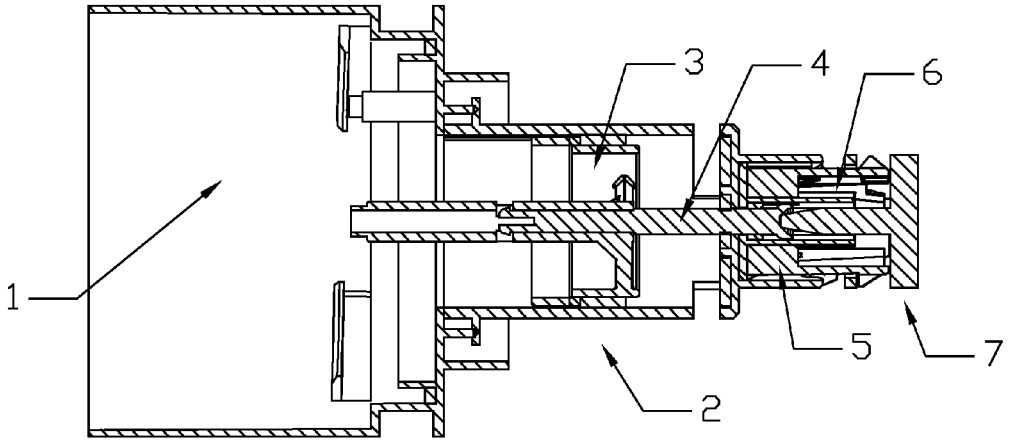
FIG. 6 is an illustrative view of the connection between the toner cartridge and the rotation transferring component.
Figure 7:
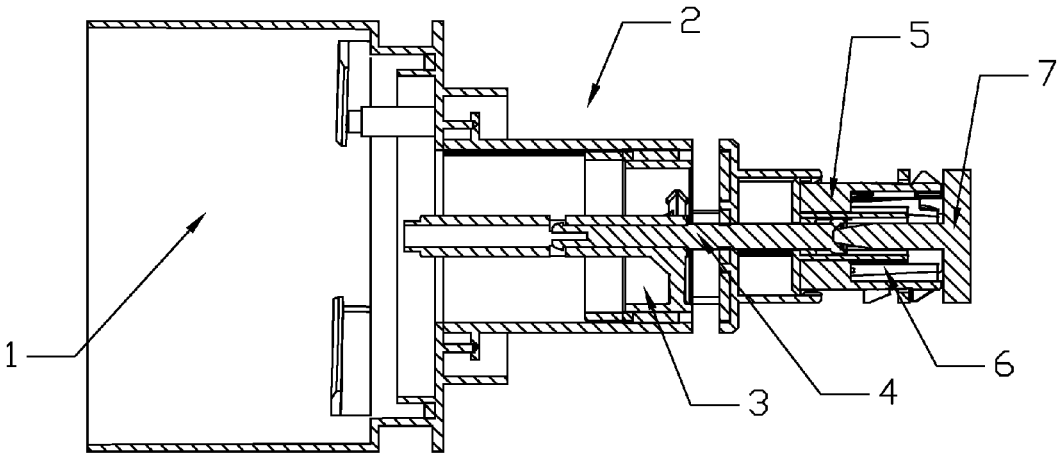
FIG. 7 is an illustrative view of the coordination between the connection component, the transmission component, and the rotation transferring component when the toner cartridge moves backwards.

As shown in FIGS. 6 and 7, when the toner cartridge is installed on the developer, the transmission shaft 71 of the rotation transferring component 7 on the developer pushes the driving rod 4 of the sealing component, the sealing component 3 is pushed backwards, and thus the toner discharge opening 201 of the toner discharge port 2 opens. The connection component 5 and the transmission component 6 are coupled with the rotation transferring component 7, and thus the toner cartridge cannot move away. After the toner cartridge is in place, the relative position of the rotary container body 1 and the developer is fixed, then the rotating operation handle, the moving component of the developer moves backwards, and it drives the rotary container body 1 of the toner cartridge to move backwards. The connection component 5 and the transmission component 6 of the toner cartridge can move axially relative to the rotary container body 1 of the toner cartridge. Therefore, when the toner cartridge moves backwards, the connection component 5 and the transmission component 6 can remain relatively fixed inside the rotation transferring component 7 of the developer. When the rotation transferring component 7 of the developer rotates, because the hook-shaped projection 51 of the connection component 5 of the toner cartridge has a sloped or arc-shaped surface in the rotational direction of the rotation transferring component 7, the driving force cannot be applied on the connection component 5, but directly to the transmission component 6 of the toner cartridge to drive the toner cartridge to rotate and to enable toner to be discharged from the toner discharge port to the developer.

In the transmission structure of the toner cartridge of the invention, the connection, the transmission, and the sealing components are independent and each performs its function; this structure provides operating stability, reduces requirements on the materials used, and allows the use of more environmentally friendly materials. Because the transmission component and the connection component can move axially relative to the toner discharge port 2, it is more convenient to rotate the operation handle.

The above description illustrates the invention by combining the drawings and the embodiments. However, the invention is not limited to these embodiments. The above embodiments are illustrative only, but do not limit the invention. Persons skilled in the art will recognize many variations by following the invention. These variations shall fall within the scope of the invention.

INDUSTRIAL APPLICABILITY

In the toner cartridge of the invention, the connection, the transmission, and the sealing components are independent and each performs its own function. This structure provides operating stability, reduces the requirements on the materials used, and allows the use of more environmentally friendly materials. Because the transmission component and the connection component can move axially relative to the toner discharge port 2, it is more convenient to rotate the operation handle.

What is claimed is:

1. A toner cartridge for the use in image processing system, comprising:

a rotary container body which is used to store the toner;

a toner discharge port which comprises a cylinder, wherein an end of the cylinder is connected with the rotary container body and the other end of the cylinder is provided with a cap; the cylinder has a toner discharge opening; and the cap is provided with a connection component compartment which is formed by outward extension of the cap;

a sealing component, which is installed inside the cylinder and it opens or closes the toner discharge opening through its axial movement;

a driving rod which is used to drive the sealing component for axial movement; an end of the driving rod passes through the cap into the cylinder and is connected with the sealing component; and the cap has an opening for the driving rod to pass through;

a connection component which is slide-connected with the inner wall of the connection component compartment; the connection component compartment rotates with the connection component and it has several hook-shaped projections; the side surface of the hook-shaped projections is sloped or arc-shaped;

a transmission component which is slide-connected with the connection component, wherein the connection component rotates with the transmission component; and the transmission component has at least one driving projection;

wherein the driving rod of the sealing component drives the sealing component to move axially, which opens the toner discharge opening.

2. The toner cartridge of claim 1, wherein the outline of the side surface of the driving projection is a triangle or arc.

3. The toner cartridge of claim 1, wherein the connection component comprises a circle-shaped base and several elastic linking arms which extend axially from the circle of the circle-shaped base; the hook-shaped projections are formed at the end of the elastic linking arms; and the base has an opening which allows the driving rod of the sealing component to pass through.

4. The toner cartridge of claim 3, wherein the inner wall of the connection component compartment is provided with axially extending ridges and the external periphery of the base is provided with sliding grooves which cooperate with the ridges.

5. The toner cartridge of claim 3, wherein the base has a positioning post that extends axially from the base; the transmission component has a bottom; and the bottom has a positioning opening which cooperates with the positioning post.

6. The toner cartridge of claim 5, wherein the bottom has an elastic driving arm that extends from the bottom; the driving projection is formed at the end of the elastic driving arm; and the bottom has an opening to allow the driving rod of the sealing component to pass through.

7. The toner cartridge of claim 1, wherein the sealing component comprises a ring and a sleeve which is coaxial with the ring; and the driving rod of the sealing component is fixed inside the sleeve.

8. The toner cartridge of claim 7, wherein the sleeve is provided with two opposite openings; the end of the driving rod of the sealing component is provided with two elastic latches; and the elastic latches are snap-fitted in the openings.

9. The toner cartridge of claim 1, wherein the end of the driving rod of the sealing component that cooperates with a transmission shaft has a pit, and wherein the transmission shaft is conically shaped.

* * * * *